US012262811B2

(12) United States Patent
Miller et al.

(10) Patent No.: US 12,262,811 B2
(45) **Date of Patent: *Apr. 1, 2025**

(54) VESSEL SINK AND METHOD OF INSTALLING SAME

(71) Applicant: Kohler Co., Kohler, WI (US)

(72) Inventors: Jason R. Miller, Sheboygan Falls, WI (US); Niels J. Eilmus, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/460,391

(22) Filed: Sep. 1, 2023

(65) Prior Publication Data

US 2024/0065437 A1 Feb. 29, 2024

Related U.S. Application Data

(63) Continuation of application No. 17/823,803, filed on Aug. 31, 2022, now Pat. No. 11,771,222, which is a continuation of application No. 17/070,606, filed on Oct. 14, 2020, now Pat. No. 11,457,736.

(60) Provisional application No. 62/915,688, filed on Oct. 16, 2019.

(51) Int. Cl.
*A47B 77/06* (2006.01)
*E03C 1/18* (2006.01)

(52) U.S. Cl.
CPC ..... *A47B 77/06* (2013.01); *E03C 1/18* (2013.01); *A47B 2220/03* (2013.01)

(58) Field of Classification Search
CPC ..... A47B 77/06; A47B 2220/03; E03C 1/18; E03C 1/182; E03C 1/33; E03C 1/186
USPC ..... 4/619, 635, 638
See application file for complete search history.

(56) References Cited

U.S. PATENT DOCUMENTS

| | | | | | |
|---|---|---|---|---|---|
| 758,447 | A * | 4/1904 | Housholder | E03C 1/18 | 4/619 |
| 3,594,830 | A * | 7/1971 | Clifton | A45D 19/04 | 4/625 |
| 4,462,126 | A * | 7/1984 | Cleaveland | E03C 1/18 | 4/619 |
| 5,016,297 | A * | 5/1991 | Sauter | E03C 1/33 | 4/619 |
| 6,591,434 | B1 * | 7/2003 | De Cleene | E03C 1/18 | 181/290 |
| 9,173,487 | B2 * | 11/2015 | Booth | E03C 1/186 | |
| 9,492,011 | B2 * | 11/2016 | Booth | E03C 1/335 | |
| 10,226,122 | B2 * | 3/2019 | Booth | A47B 77/022 | |
| 11,457,736 | B2 * | 10/2022 | Miller | E03C 1/18 | |
| 11,771,222 | B2 * | 10/2023 | Miller | A47B 77/06 | 4/630 |

(Continued)

*Primary Examiner* — Charles P. Cheyney
(74) *Attorney, Agent, or Firm* — Husch Blackwell LLP

(57) ABSTRACT

A sink includes a front wall, a first side wall, and a second side wall. The front wall includes an inner surface that defines part of a basin of the sink, and an outer surface located opposite the inner surface that is configured to be exposed in front of an opening of a cabinet in which the s sink is installed. The front wall includes first and second lateral portions that extend outwardly past the first and second side walls. The first and second lateral portions of the front wall are configured to at least partially overlap a front face of the cabinet adjacent the opening, so as to substantially conceal the opening when the sink is installed thereto.

19 Claims, 4 Drawing Sheets

(56) References Cited

U.S. PATENT DOCUMENTS

| | | | | |
|---|---|---|---|---|
| 12,123,182 | B2 * | 10/2024 | Ellingsen | E03C 1/32 |
| 2009/0113618 | A1 * | 5/2009 | Slayton | A47K 1/02 4/653 |
| 2012/0222211 | A1 * | 9/2012 | Booth | E03C 1/18 4/619 |
| 2020/0199858 | A1 * | 6/2020 | Eilmus | E03C 1/18 |
| 2021/0112978 | A1 * | 4/2021 | Miller | E03C 1/18 |
| 2021/0404643 | A1 * | 12/2021 | Eilmus | E03C 1/182 |
| 2022/0282468 | A1 * | 9/2022 | Harris | E03C 1/33 |

* cited by examiner

VESSEL SINK AND METHOD OF INSTALLING SAME

CROSS-REFERENCE TO RELATED APPLICATIONS

This application is a continuation of application Ser. No. 17/823,803, filed Aug. 31, 2022, which is a continuation of application Ser. No. 17/070,606 filed Oct. 14, 2020, now U.S. Pat. No. 11,457,736, which claims the benefit of Provisional Application No. 62/915,688, filed Oct. 16, 2019, the entire disclosures of which are hereby fully incorporated herein by reference.

BACKGROUND

The present disclosure relates generally to sinks. More specifically, the present disclosure relates to a vessel sink having features that facilitate installation of the sink into a cabinet.

Generally speaking, some sinks have a "vessel" design including a front wall having an inner surface that defines part of a basin of the sink and an outer facing surface that is exposed to view when installed in a cabinet. These sinks are typically installed in an opening in a cabinet that has approximately the same dimensions as the front wall of the basin, such that the sink is received in the opening with the outer facing surface exposed to view. Some vessel sinks are designed such that the outer facing surface is exposed in the opening of the cabinet to provide a popular farmhouse appearance. Thus, the opening in the cabinet must be precisely cut to avoid unsightly gaps or rough cut edges between the cabinet and sink, which can be difficult and time consuming for a typical user or installer to perform.

SUMMARY

At least one embodiment relates to a sink. The sink includes a front wall, a rear wall, a first side wall, a second side wall, and a bottom wall. The front wall includes an inner surface and an outer surface. The rear wall is located opposite the front wall. The first side wall extends from the front wall to the rear wall. The second side wall is located opposite the first side wall, and extends from the front wall to the rear wall. The bottom wall extends between the front wall, the rear wall, the first side wall, and the second side wall, so as to define at least one basin of the sink. The inner surface of the front wall defines part of the at least one basin and the outer surface of the front wall defines an outer facing surface of the sink that is configured to be exposed in front of an opening in a front face of a cabinet. The front wall further comprises a first lateral portion extending outwardly past the first side wall and a second lateral portion 5 extending outwardly past the second side wall. The first lateral portion and the second lateral portion are each configured to at least partially overlap the front face of the cabinet adjacent the opening, such that the front wall of the sink substantially conceals edges that define the opening.

Another embodiment relates to a sink. The sink includes a front wall, a rear wall, a first side wall, a second side wall, and a bottom wall. The front wall includes an inner surface and an outer surface. The rear wall is located opposite the front wall. The first side wall extends from the front wall to the rear wall. The second side wall is located opposite the first side wall, and extends from the front wall to the rear wall. The bottom wall extends between the front wall, the rear wall, the first side wall, and the second side wall, so as to define at least one basin of the sink. The inner surface of the front wall defines part of the at least one basin and the outer surface of the front wall defines an outer facing surface of the sink that is configured to be exposed in front of an opening in a front face of a cabinet. The entire front wall is configured to be positioned in front of the front face of the cabinet when the sink is installed in the cabinet, such that the at least one basin extends forward past the front face.

Another embodiment relates to a method of installing a sink into a cabinet. The method includes aligning a sink with an opening in a front face of the cabinet, wherein the opening is defined by at least two lateral edges, and wherein the sink includes a front wall, a rear wall, first side wall, a second side wall, and a bottom wall. The front wall includes an inner surface and an outer surface. The rear wall is located opposite the front wall. The first side wall extends from the front wall to the rear wall. The second side wall is located opposite the first side wall, and extends from the front wall to the rear wall. The bottom wall extends between the front wall, the rear wall, the first side wall, and the second side wall, so as to define at least one basin of the sink. The inner surface of the front wall defines part of the at least one basin and the outer surface of the front wall defines an outer facing surface of the sink. The front wall further comprises a first lateral portion extending outwardly past the first side wall and a second lateral portion extending outwardly past the second side wall. The method further includes lowering the sink such that the first and second lateral portions are disposed in front of the front face of the cabinet adjacent the opening, so as to substantially overlap the at least two lateral edges. The method further includes sliding the sink in a rearward direction such that a rear surface defined by the first and second lateral portions of the front wall engages the front face of the cabinet.

DETAILED DESCRIPTION

Figure 1:
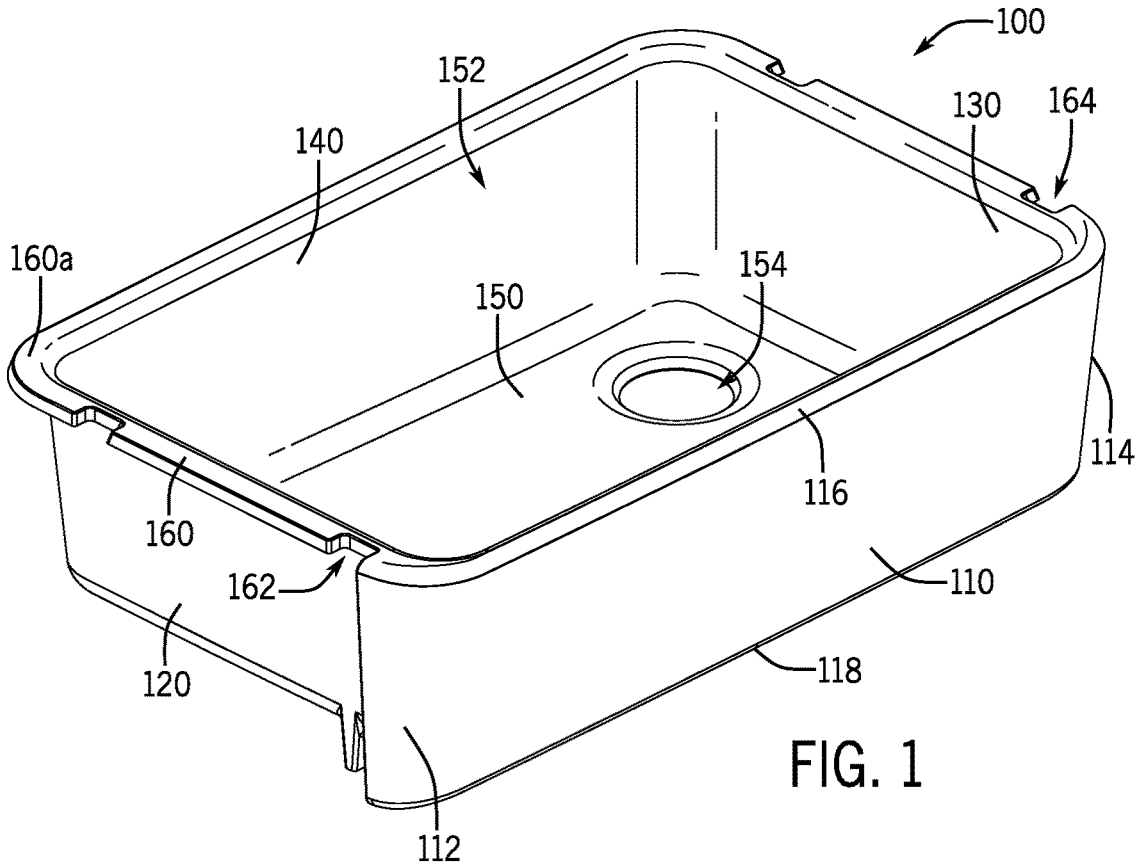
FIG. 1 is a perspective view of a sink according to an exemplary embodiment.
Figure 2:
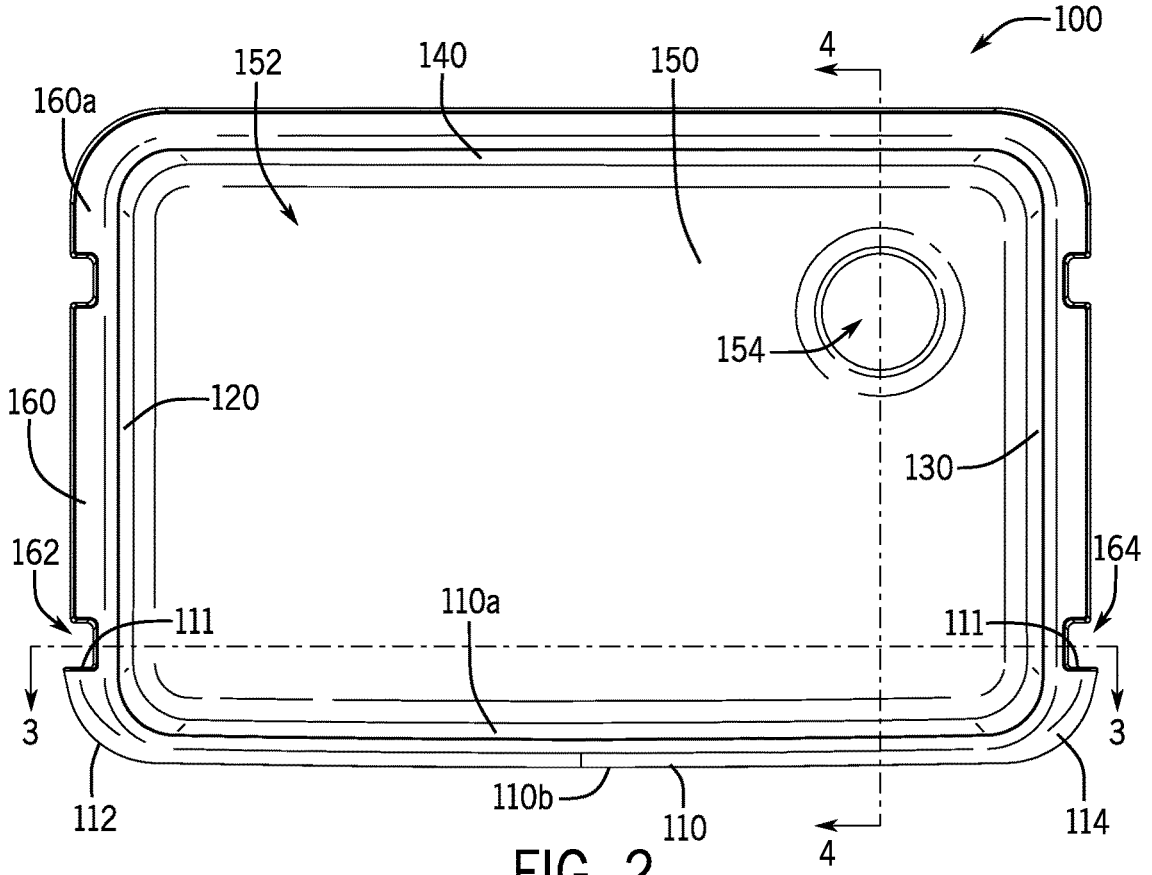
FIG. 2 is a top view of the sink of FIG. 1.
Figure 3:
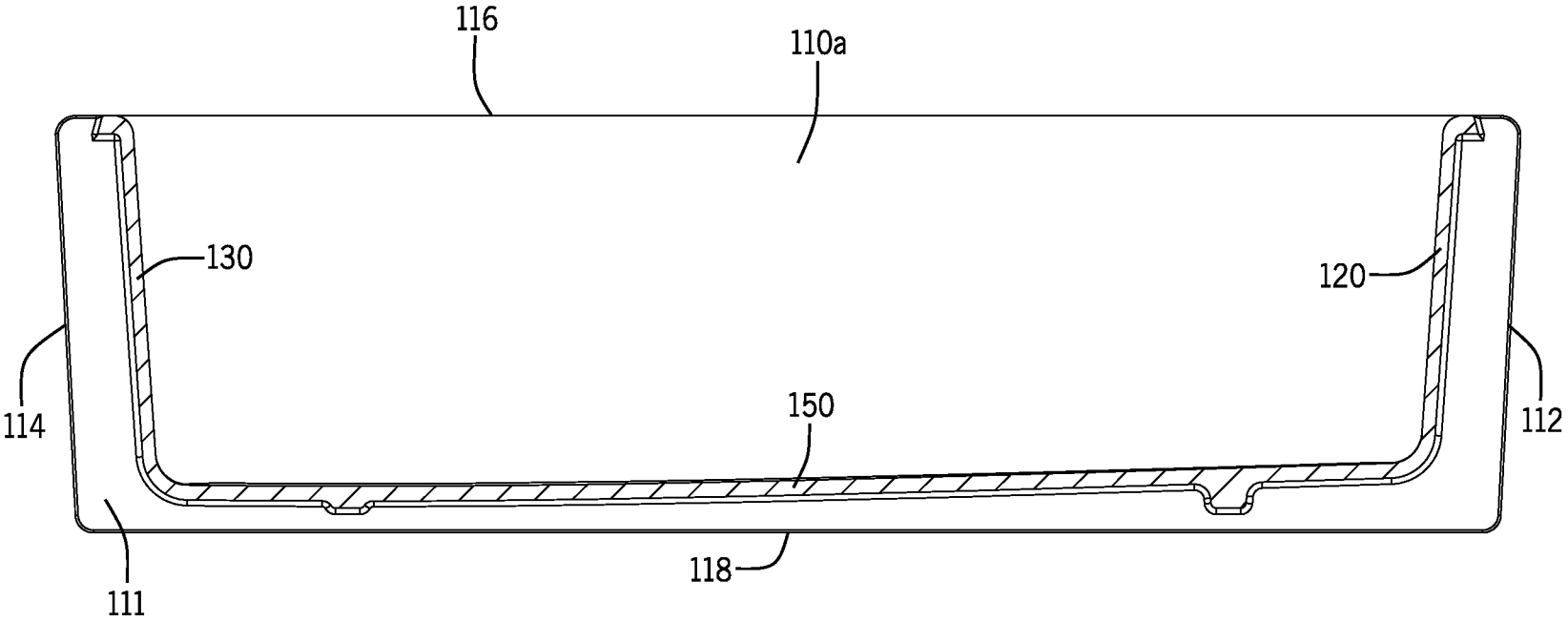
FIG. 3 is a cross-sectional view of the sink of FIG. 2 taken along line 3-3.
Figure 4:
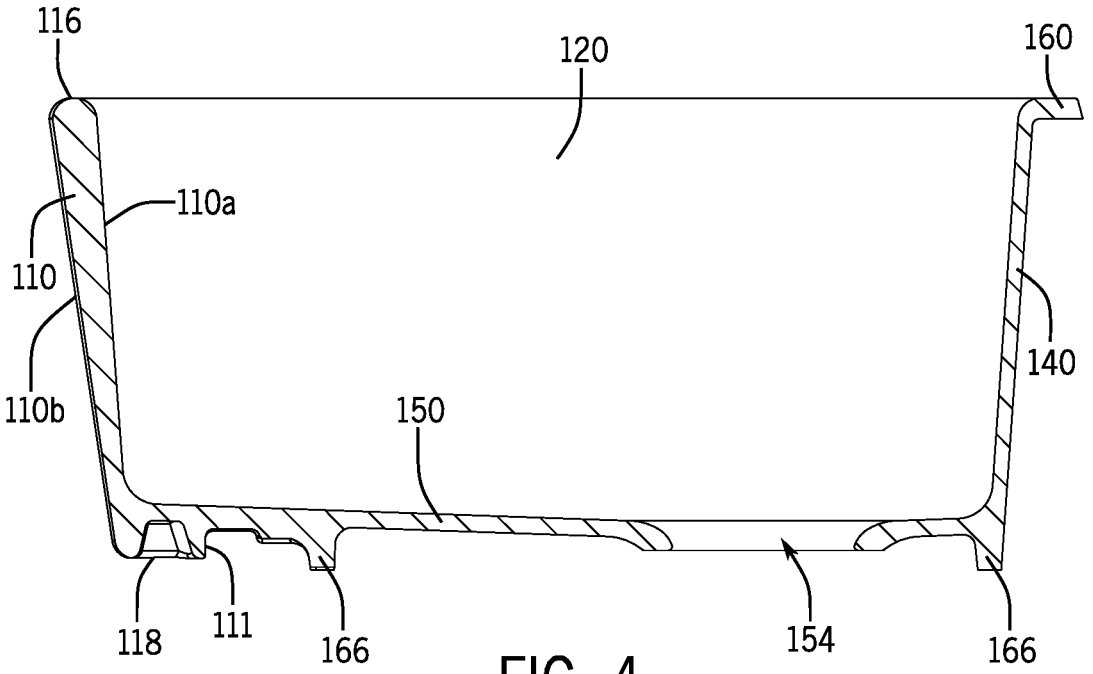
FIG. 4 is another cross-sectional view of the sink of FIG. 2 taken along line 4-4.
Figure 5:
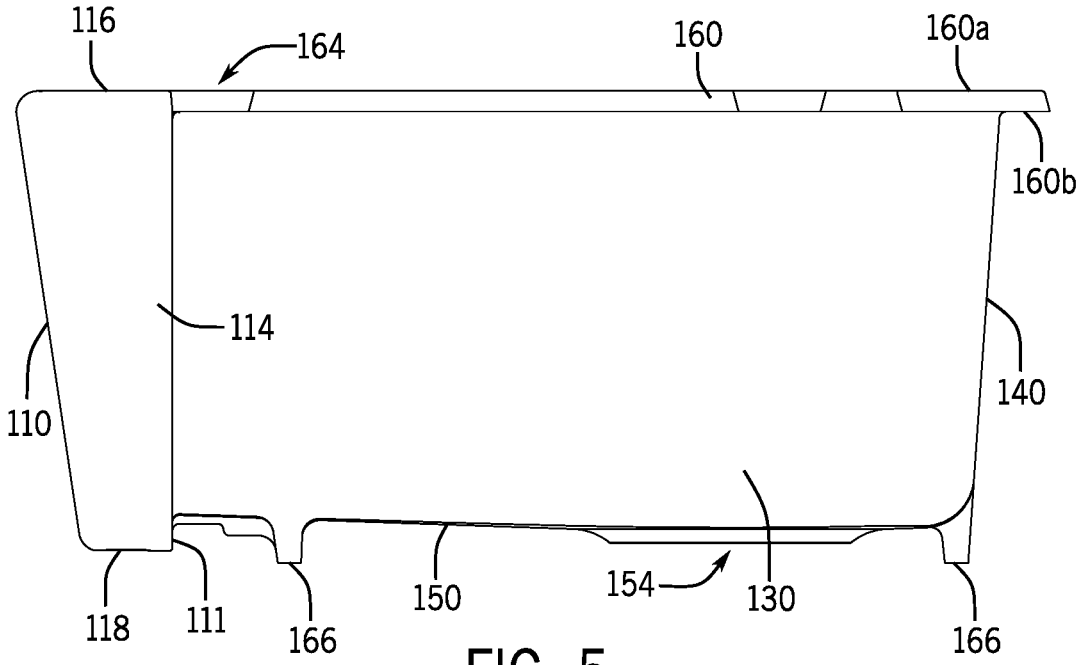
FIG. 5 is a side view of the sink of FIG. 1.

Referring generally to the FIGURES, disclosed herein is a vessel sink that includes features that provide for easier installation and improved aesthetic appeal, as compared to traditional vessel-style sinks. The disclosed vessel sink includes a front wall having an inner surface that defines part of a basin of the sink. The front wall also has an outer surface located opposite the inner surface that is configured to be exposed to view in front of an opening of a cabinet in which the vessel sink is installed. The front wall includes lateral portions (e.g., wings, extensions, etc.) that extend outwardly past the sidewalls of the basin, and a bottom portion (e.g., wing, extension, etc.) that extends outwardly past the bottom wall of the basin. The lateral portions and the bottom portion of the front wall can at least partially overlap a front face of the cabinet adjacent the opening in the cabinet, so as to substantially conceal the opening when the vessel sink is installed thereto. In this manner, the front wall of the basin can help to reduce or eliminate unnecessary trimming of the cabinet or adjusting of the sink during installation and can provide for a cleaner aesthetic when the sink is installed in the cabinet, as compared to conventional vessel sinks. In addition, the front wall of the sink is positioned forward of the front face of the cabinet, such that the basin extends in front of the front face to provide a larger working area for a user to access.

Referring to FIGS. 1-5, a sink 100 is shown according to an exemplary embodiment. In the exemplary embodiment shown, the sink 100 is configured as an undermount sink. That is, the sink 100 is configured to be mounted under a countertop between a portion of a cabinet and the countertop. According to other exemplary embodiments, the sink 100 may be configured as a top mount sink. The sink 100 includes a front wall 110, a first side wall 120, a second side wall 130, and a rear wall 140 coupled to, or integrally formed with, a bottom wall 150 to define a basin 152 of the sink. The basin 152 has a generally rectangular shape, although the basin 152 may be configured to have other shapes according to other exemplary embodiments. The sink 100 may be configured to have a single basin, as shown, or may be configured to have a double basin including a partition or saddle separating the two basins.

According to an exemplary embodiment, the sink 100 is integrally formed by a casting process using, for example, cast iron. The sink 100 may include a variety of different surface finishes, such as an enamel coating. According to other exemplary embodiments, the sink 100 may be cast from other materials or combinations of materials besides cast iron (e.g., ceramic, composite stone, etc.). According to another exemplary embodiment, one or more of the various walls of the sink 100 may be coupled together instead of integrally formed. As shown in FIGS. 1-5, the front wall 110 includes an inner surface 110*a* that defines part of the basin 152 and an outer surface 110*b* that is configured to be exposed in front of an opening in a cabinet when the sink 100 is installed into the cabinet, the details of which are discussed in the paragraphs that follow.

Still referring to FIGS. 1-5, the front wall 110 further includes a first lateral portion 112 extending laterally outwardly past the first side wall 120 and a second lateral portion 114 extending laterally outwardly past the second side wall 130. The front wall 110 further includes an upper portion 116 that defines an upper end of the front wall 110, and a bottom portion 118 extending downwardly past the bottom wall 150 that defines a lower end of the front wall 110. The first lateral portion 112, the second lateral portion 114, and the bottom portion 118 cooperatively define a rear surface 111. The rear surface 111 is oriented in a substantially upright or vertical orientation. The rear surface 111 is substantially planar and is configured to engage a front face of a cabinet, as discussed below with reference to FIGS. 6-8. A rim 160 extends outwardly in a substantially horizontal orientation along an upper periphery of the first side wall 120, the rear wall 140, and the second side wall 130. The rim 160 defines an upper rim surface 160*a* that is substantially coplanar with the upper portion 116, and a lower rim surface 160*b* that is configured to engage a portion of a cabinet to substantially support the sink 100 during installation. The sink 100 further includes a drain 154 disposed in the bottom wall 150. The sink 100 may include one or more feet 166 extending from the bottom wall 150 to help with installation of the sink into a cabinet and to help prevent damage to the bottom portion 118 of the front wall when the sink 100 is resting on a surface.

Still referring to FIGS. 1-5, the rim 160 extends continuously along the first side wall 120, the rear wall 140, and the second side wall 130. The rim 160 terminates along the first side wall 120 at a first notch 162 (e.g., cutout, channel, etc.). Similarly, the rim 160 terminates along the second side wall 130 at a second notch 164 located opposite the first notch 162. The first notch 162 extends between a first portion of the rim 160 (located along the first side wall 120) and the first lateral portion 112 toward the first side wall 120. The second notch 164 extends between a second portion of the rim 160 (located along the second side wall 130) and the second lateral portion 114 toward the second side wall 130. Each of the first notch 162 and the second notch 164 defines a generally U-shaped area that is configured to receive a portion of a front face of a cabinet therein to, advantageously, facilitate installation of the sink 100, the details of which are discussed below with reference to FIGS. 6-8. The first notch 162 and the second notch 164 may be sized to receive different cabinet faces having different thicknesses to allow for a variety of different installation configurations.

As shown in FIGS. 1-5, the front wall 110 has a generally arcuate shape extending between the first and second lateral portions 112,114, such that the inner surface 110*a* is generally concave and the outer surface 110*b* is generally convex. The front wall 110 is also oriented at an acute angle relative to vertical such that the front wall 110 extends gradually away from the bottom wall 150 toward the upper portion 116. The outer surface 110*b* curves toward the sidewalls 120,130 at the first and second lateral portions 112,114, respectively. The rear surface 111 is generally planar or flat and is oriented in a substantially vertical direction, such that the rear surface 111 can abut a front face of a cabinet during installation of the sink 100, as discussed in greater detail below. In this way, the front wall 110 can extend outwardly in front of a front face of the cabinet past the opening through which the sink extends, so as to substantially conceal the opening and to provide a popular farmhouse appearance. Furthermore, since the front wall 110 is configured to be positioned forward of the front face of the cabinet, the basin 152 also extends in front of the front face, which can provide a larger working area for a user to access.

Figure 6:
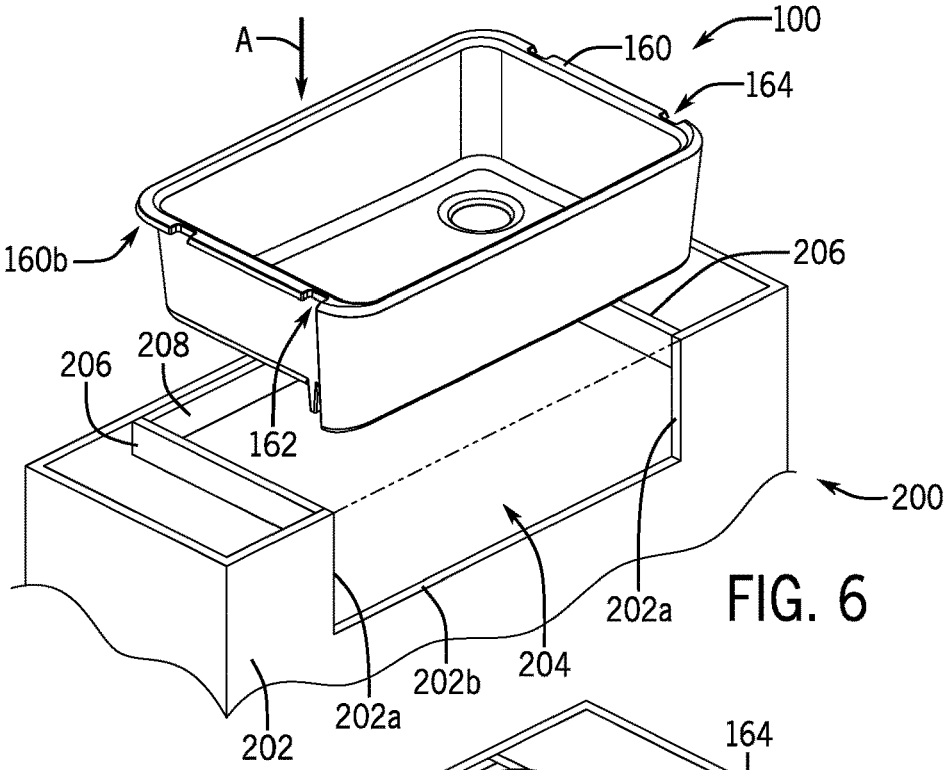
FIGS. 6-8 illustrate a method of installing a sink into a cabinet according to an exemplary embodiment.
Figure 7:
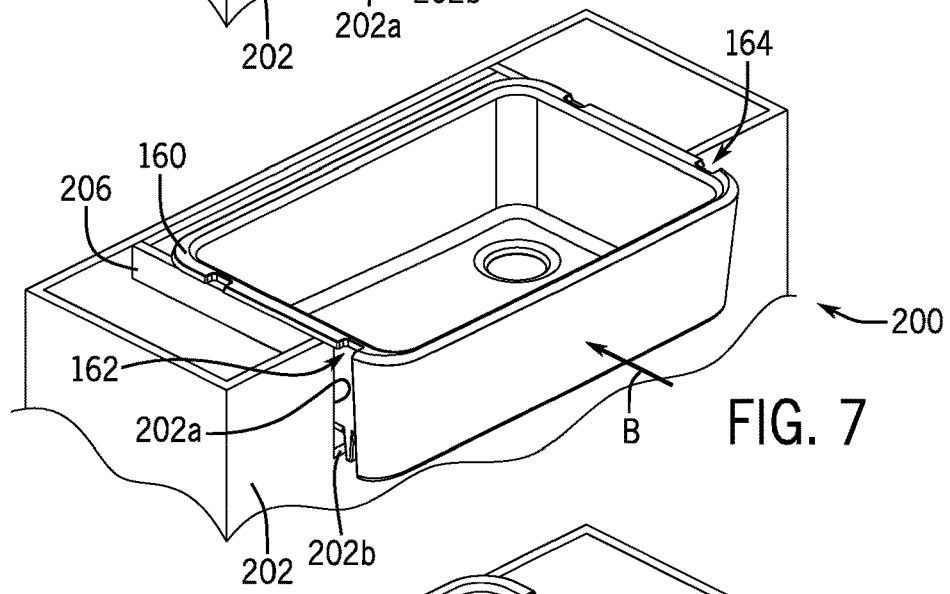
Figure 8:
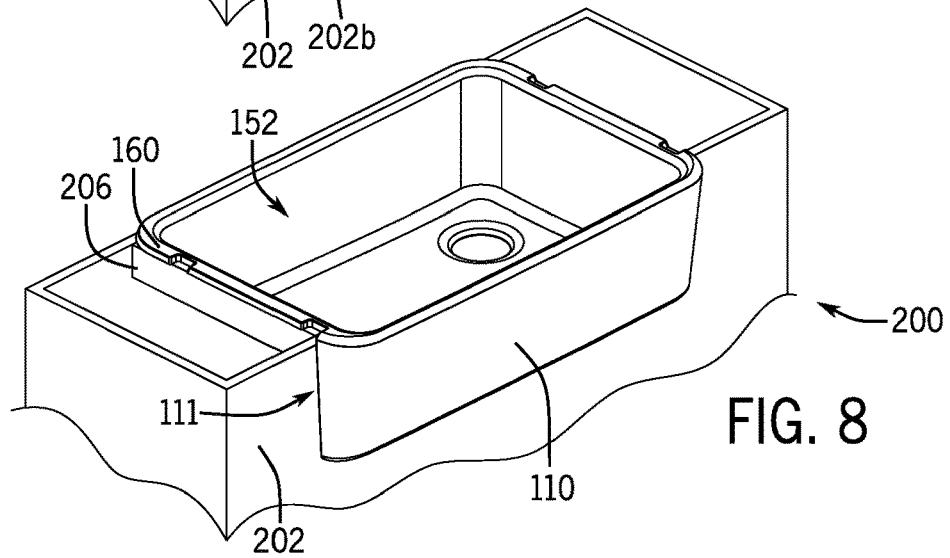

Referring to FIGS. 6-8, the sink 100 is shown being installed into a cabinet 200 according to an exemplary embodiment. The cabinet 200 may be a standard kitchen cabinet that includes a false drawer front for concealing an opening 204 in a front face 202 thereof. According to another exemplary embodiment, the cabinet 200 is a custom kitchen cabinet that requires a user or an installer to cut the opening 204 in the front face 202 for installation of the sink 100. The sink 100 may include installation instructions along with a cutting template to assist a user or an installer with modifying the cabinet 200 to include the opening 204. For example, the template may be placed on the front face 202 and an installer may cut around the template to form the opening 204 therein, which is defined by lateral edges 202*a* and bottom edge 202*b*. The cabinet 200 may further include lateral support members 206 and a rear support member 208 coupled within an interior of the cabinet for substantially supporting the sink 100 at the rim 160. The lateral support members 206 and the rear support member 208 may be positioned such that the sink 100 is substantially flush with a top edge of the cabinet when installed, so as to facilitate installation of a countertop above the sink 100 on the cabinet 200.

Still referring to FIGS. 6-8, the opening 204 is sized to receive a portion of the basin 152 therein and to be substantially concealed by the rear surface 111 of the front wall 110. In other words, the rear surface 111 is configured to overlap the lateral edges 202*a* and the bottom edge 202*b*, so as to substantially conceal the opening 204 when the sink 100 is installed into the cabinet 200. Thus, the opening 204 can have variations in size due to, for example, manufacturing tolerances or imprecise cutting of the opening 204, while still being substantially concealed by the front wall 110, so as to provide for an improved aesthetic as compared to conventional vessel-style sinks. In this manner, the disclosed sink 100 can reduce the amount of secondary operations required during installation of the sink, such as trimming the cabinet or adjusting the position of the sink, which is particularly well-suited for inexperienced installers or do-it-yourselfers.

In a first installation step shown in FIG. 6, the sink 100 is lowered in a direction indicated generally by arrow "A" toward the cabinet 200 with the first notch 162 aligned with one of the lateral edges 202*a* and the second notch 164 aligned with the other lateral edge 202*a*. The sink 100 is lowered until the bottom surface 160*b* of the rim 160 engages the lateral support members 206 and the rear support member 208. The lateral edges 202*a* are also received in the first and second notches 162,164, respectively, as shown in FIG. 7. In a second step shown in FIG. 7, the sink is translated or slid in a rearward direction toward the cabinet 200 along the lateral support members 206, indicated generally by arrow "B", until the rear surface 111 engages the front face 202, as shown in the final installed position in FIG. 8. As shown in FIG. 8, the rear surface 111 is positioned substantially flush against the front face 202, with the first and second lateral portions 112, 114 substantially overlapping the lateral edges 202*a*, and the bottom portion 118 substantially overlapping the bottom edge 202*b*. In this way, the front wall 110 substantially conceals the opening 204 from view, thereby providing a clean, professional looking installation. In addition, the front wall 110 is positioned forward of the front face 202*a* in the installed position of FIG. 8, such that the basin 152 extends past the front face 202*a* to provide a larger working area for a user to access.

The disclosed vessel style sink includes a front wall having lateral portions and a bottom portion that can overlap a front face of a cabinet adjacent an opening in the cabinet, so as to substantially conceal the opening when the vessel sink is installed thereto. In this manner, the front wall of the basin can help to reduce or eliminate unnecessary trimming of the cabinet or adjusting of the sink during installation and can provide for a cleaner aesthetic when the sink is installed in the cabinet, as compared to conventional vessel sinks. In addition, the front wall of the sink is positioned forward of the front face of the cabinet, such that the basin extends in front of the front face to provide a larger working area for a user to access.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein.

What is claimed is:

1. A sink comprising:

at least one basin having a first side wall, second side wall, and a front wall, wherein the front wall includes an inner surface and an outer surface, wherein at least a portion of the inner surface of the front wall is configured to be positioned forward of a front face of a cabinet when installed in an opening in the front face of the cabinet;

a rim extending outwardly in a substantially horizontal orientation along an upper periphery of the first side wall and the second side wall;

a first notch at a first end of the rim along the first side wall; and a second notch at a first end of the rim along the second side wall and opposite the first notch; and wherein the first notch and the second notch are each configured to receive a portion of the front face of the cabinet therein.

2. The sink of claim 1, wherein the front wall further comprises a first lateral portion, a second lateral portion, and a bottom portion extending downwardly past a bottom wall of the plurality of walls.

3. The sink of claim 2, wherein the first lateral portion, the second lateral portion, and the bottom portion cooperatively define a rear surface configured to engage the front face of the cabinet.

4. The sink of claim 1, wherein the entire front wall is configured to be positioned in front of the front face of the cabinet when the sink is installed in the cabinet, such that the at least one basin extends forward past the front face.

5. The sink of claim 1, wherein the basin further includes wall, wherein the rim terminates along the first side wall at a first notch, and wherein the rim terminates along the second side wall at a second notch located opposite the first notch.

6. The sink of claim 2, wherein the first notch extends between a first portion of the rim and the first lateral portion, and wherein the second notch extends between a second portion of the rim and the second lateral portion.

7. The sink of claim 1, wherein the front wall is oriented at an acute angle relative to a vertical plane.

8. A sink comprising: a plurality of walls cooperatively defining at least one basin, wherein a front wall of the plurality of walls includes an inner surface and an outer surface, wherein the inner surface of the front wall defines part of the at least one basin, and the outer surface of the front wall defines an outer facing surface of the sink that is configured to be exposed in front of an opening in a front face of a cabinet, and wherein the entire front wall is configured to be positioned forward of the front face of the cabinet when the sink is installed therein;

a rim extending outwardly in a substantially horizontal orientation along an upper periphery of at least one of the plurality of walls; and a first notch at a first end of the rim, wherein the first notch is configured to receive a portion of the front face of the cabinet therein.

9. The sink of claim 8, wherein the plurality of walls further includes a first side wall, a second side wall, a rear wall, and a bottom wall, wherein the front wall further comprises a first lateral portion extending outwardly past the first side wall and a second lateral portion extending outwardly past the second side wall, and wherein the first lateral portion and the second lateral potion are each configured to at least partially overlap the front face of the cabinet adjacent the opening, such that the front wall of the sink substantially conceals edges that define the opening.

10. The sink of claim 9, wherein the front wall further comprises a bottom portion extending downwardly past the bottom wall.

11. The sink of claim 10, wherein the first lateral portion, the second lateral portion, and the bottom portion cooperatively define a rear surface configured to engage the front face of the cabinet.

12. The sink of claim 9, wherein the rim extends outwardly in the substantially horizontal orientation along an upper periphery of the first side wall, the rear wall, and the second side wall, wherein the rim terminates along the first side wall at the first notch, and wherein the rim terminates along the second side wall at a second notch located opposite the first notch.

13. The sink of claim 12, wherein the first notch extends between a first portion of the rim and the first lateral portion, and wherein the second notch extends between a second portion of the rim and the second lateral portion.

14. The sink of claim 12, wherein the first notch and the second notch are each configured to receive a portion of the front face of the cabinet therein.

15. The sink of claim 8, wherein the front wall is oriented at an acute angle relative to a vertical plane.

16. A method of installing a sink into a cabinet, the method comprising: aligning a sink with an opening defined in a front face of the cabinet, wherein the sink comprises a plurality of walls cooperatively defining at least one basin, wherein a front wall includes an inner surface and an outer surface, and wherein sink further comprises a rim extending outwardly in a substantially horizontal orientation along an upper periphery of at least one wall of the plurality of walls, and a first notch at a first end of the rim; and installing the sink within the opening such that at least a rear portion of the front wall engages the front face of the cabinet and at least a portion of the inner surface of the front wall is positioned forward of the front face of the cabinet, and a portion of the front face of the cabinet is received within the first notch.

17. The method of claim 16, wherein the front wall further comprises a bottom portion extending downwardly past the bottom wall, and wherein the bottom portion defines part of the rear surface that engages the front face of the cabinet.

18. The method of claim 16, wherein an entirety of the front wall is positioned in front of the front face of the cabinet when the sink is installed in the cabinet such that the at least one basin extends forward past the front face.

19. The method of claim 16, wherein the plurality of walls further includes a first side wall and a second side wall, wherein the rim extends outwardly in the substantially horizontal orientation along an upper periphery of the first side wall and the second side wall, wherein the rim terminates along the first side wall at the first notch, wherein the rim terminates along the second side wall at a second notch located opposite the first notch, and wherein at least a portion of the front face of the cabinet is received in each of the first and second notches after installing the sink.

* * * * *